US008179341B2

(12) United States Patent
Yamada

(10) Patent No.: US 8,179,341 B2
(45) Date of Patent: May 15, 2012

(54) PLASMA DISPLAY DEVICE WITH POWER CONSUMPTION FEATURES

(75) Inventor: Kazuhiro Yamada, Osaka (JP)

(73) Assignee: Panasonic Corporation, Osaka (JP)

( * ) Notice: Subject to any disclaimer, the term of this patent is extended or adjusted under 35 U.S.C. 154(b) by 467 days.

(21) Appl. No.: 12/525,604

(22) PCT Filed: Oct. 31, 2008

(86) PCT No.: PCT/JP2008/003138

§ 371 (c)(1),
(2), (4) Date: Aug. 3, 2009

(87) PCT Pub. No.: WO2009/060578

PCT Pub. Date: May 14, 2009

(65) Prior Publication Data

US 2010/0128017 A1 May 27, 2010

(30) Foreign Application Priority Data

Nov. 5, 2007 (JP) ..... 2007-286984

(51) Int. Cl.
*G09G 3/28* (2006.01)

(52) U.S. Cl. ..... 345/60

(58) Field of Classification Search ..... 345/60–72, 345/212; 315/169.4
See application file for complete search history.

(56) References Cited

U.S. PATENT DOCUMENTS

| | | | | |
|---|---|---|---|---|
| 5,619,507 | A * | 4/1997 | Tsuda | 370/350 |
| 6,690,388 | B2 * | 2/2004 | Kasahara et al. | 345/690 |
| 6,724,356 | B1 * | 4/2004 | Kojima et al. | 345/60 |
| 6,987,510 | B2 * | 1/2006 | Iwami et al. | 345/211 |

FOREIGN PATENT DOCUMENTS

| | | | |
|---|---|---|---|
| JP | 10-187093 | A | 7/1998 |
| JP | 2000-066638 | A | 3/2000 |
| JP | 2000-112432 | A | 4/2000 |
| JP | 2002-149109 | A | 5/2002 |
| JP | 2003-140596 | A | 5/2003 |
| JP | 2003-140597 | A | 5/2003 |
| JP | 2004-021166 | A | 1/2004 |
| JP | 2006-053547 | A | 2/2006 |

OTHER PUBLICATIONS

International Search Report for Application No. PCT/JP2008/003138, Jan. 27, 2009, Panasonic Corporation.

* cited by examiner

*Primary Examiner* — Chanh Nguyen
*Assistant Examiner* — Pegeman Karimi
(74) *Attorney, Agent, or Firm* — RatnerPrestia

(57) ABSTRACT

An image signal processing circuit of a plasma display device includes an image data replacement circuit for replacing image data for a predetermined subfield with image data having less power consumption in a data electrode drive circuit; a power calculating circuit for calculating power consumption in the data electrode drive circuit and outputting power consumption for each field as field power; a power predicting circuit for predicting the field power when the number of predetermined subfields is decreased and outputting it as predicted field power; and an SF determination circuit. The SF determination circuit increases the number of predetermined subfields when the field power is not less than a predetermined power threshold, and decreases the number of predetermined subfields when the field power is less than the predetermined power threshold and the predicted field power is less than the predetermined power threshold.

5 Claims, 7 Drawing Sheets

PLASMA DISPLAY DEVICE WITH POWER CONSUMPTION FEATURES

THIS APPLICATION IS A U.S. NATIONAL PHASE APPLICATION OF PCT INTERNATIONAL APPLICATION PCT/JP2008/003138.

TECHNICAL FIELD

The present invention relates to plasma display devices employing an AC-type plasma display panel.

BACKGROUND ART

A plasma display panel (hereafter briefly referred to as a "panel") is a typical image display device in which many pixels are aligned in plane, and many discharge cells including scan electrode, sustain electrode, and data electrode are formed in the panel. Gas discharge that takes place inside each discharge cell excites phosphor to emit light for color display.

In a plasma display device employing this type of panel, a subfield method is mostly adopted for displaying images. In this method, one field consists of a plurality of subfields to which predetermined luminance weight is given, respectively. An image is displayed by controlling emission and non-emission of light from each discharge cell for each subfield.

The plasma display device includes a scan electrode drive circuit for driving scan electrodes, a sustain electrode drive circuit for driving sustain electrodes, and a data electrode drive circuit for driving data electrodes. The drive circuit of each electrode applies a drive voltage waveform needed for each electrode. With respect to the data electrode drive circuit, an address pulse for independent address operation in each of many data electrode needs to be applied, based on an image signal, and thus the data electrode drive circuit is normally configured with an exclusive IC. Looking at the panel from the data electrode drive circuit, each data electrode is a capacitive load having stray capacitance between the data electrode and adjacent data electrode, scan electrode, or sustain electrode. Accordingly, this capacitance needs to be charged or discharged in order to apply a drive voltage waveform to each data electrode. For this purpose, power supply is necessary. However, to configure a drive circuit with IC, power consumption in the data electrode drive circuit needs to be suppressed as much as possible.

The power consumption in the data electrode drive circuit increases as discharging and charging current of the capacitance of data electrode increases. This discharging and charging current largely depends on an image signal to be displayed. For example, if no address pulse is applied to all data electrodes, the discharging and charging current is 0, and thus the power consumption becomes minimum. Contrarily, if an address pulse is applied to all data electrodes, the discharging and charging current also becomes 0. Accordingly, the power consumption is small. However, if the address pulse is applied to data electrodes at random, the discharging and charging current increases. In particular, if the address pulse is applied alternately to adjacent data electrodes, static capacitance between the adjacent data electrodes, and static capacitance between the scan electrode and sustain electrode will be discharged and charged. This results in extremely large power consumption.

One proposed method of reducing power consumption in the data electrode drive circuit is to restrict power consumption in the data electrode drive circuit by calculating power consumption in the data electrode drive circuit based on the image signal, and prohibiting the address operation sequentially from a subfield with the smallest luminance weight if power consumption is large. (For example, refer to Patent Document 1.) Alternatively, another method disclosed is to reduce power consumption in the data electrode drive circuit by replacing an image signal with an image signal that reduces power consumption in the data electrode drive circuit. (For example, refer to Patent Document 2.)

To reduce the power consumption in the data electrode drive circuit, a circuit for detecting or calculating the power consumption in the data electrode drive circuit and a circuit for reducing the power consumption in the data electrode drive circuit are provided, and the power consumption in the data electrode drive circuit is controlled to be below a predetermined power threshold. Control types include feedback and feed-forward. To ensure suppression of the power consumption below the predetermined power threshold, the feedback control is relatively simple and effective. However, a simple feedback control results in repetitive increase and decrease of the power consumption in the data electrode drive circuit around the predetermined power threshold. This results in flickering. To prevent oscillation due to the feedback control, the power threshold when the power consumption increases is set greater than the power threshold when the power consumption decreases so as to give hysteresis characteristics to the control. However, since the increase and decrease of power consumption largely depends on image signal, it is practically difficult to set two appropriate predetermined power thresholds.

Patent Document 1: Japanese Patent Unexamined Publication No. 2000-66638

Patent Document 2: Japanese Patent Unexamined Publication No. 2002-149109

SUMMARY OF THE INVENTION

A plasma display device of the present invention includes a panel in which a plurality of discharge cells having data electrodes are aligned, a data electrode drive circuit for driving the data electrodes, and an image signal processing circuit for processing an image signal and supplying image data for each subfield to the data electrode drive circuit.

The image signal processing circuit includes an image data replacement circuit, a power calculating circuit, a power predicting circuit, and SF determination circuit. The image data replacement circuit replaces image data for a predetermined subfield with image data having less power consumption in the data electrode drive circuit. The power calculating circuit calculates power consumption in the data electrode drive circuit, and outputs the power consumption in each field as field power. The power predicting circuit stores calculated power consumption in the data electrode drive circuit corresponding to a subfield, and predicts field power when the number of predetermined subfields is increased or decreased, based on stored calculated power consumption and field power. Then, the field power obtained through prediction is output as predicted field power.

The SF determination circuit determines the number of predetermined subfields based on the field power and the predicted field power. In other words, the SF determination circuit increases the number of predetermined subfields when the field power is the same or greater than a predetermined power threshold. The SF determination circuit decreases the number of predetermined subfields when the field power is less than the predetermined power threshold and also the predicted field power is less than the predetermined power threshold. With this structure, the feedback control is implemented using a single predetermined power threshold so as to offer the plasma display that can reduce power consumption in the data electrode drive circuit without causing flickering.

The image data replacement circuit in the plasma display device of the present invention may replace image data with image data having low power consumption in the data electrode drive circuit by changing image data for a predetermined subfield to "0". This structure achieves a significant power suppression effect.

The image signal processing circuit in the plasma display device of the present invention further includes a scene change detecting circuit for determining a change in a scene when a detected APL of the image signal in each field changes exceeding a predetermined value. If the scene change detecting circuit detects a change in a scene, a value of power consumption stored in the power predicting circuit is preferably reset.

The image data replacement circuit in the plasma display device of the present invention adds a subfield having the next largest luminance weight after a subfield having the largest luminance weight in the predetermined subfield to the predetermined subfield when the number of predetermined subfields is increased corresponding to an output from the SF determination circuit. When the number of predetermined subfields is decreased, a subfield having the largest luminance weight in the predetermined subfield is preferably excluded from the predetermined subfield.

The power predicting circuit in the plasma display device of the present invention includes a 1-V delay device, a subtractor, a memory, and an adder. The 1-V delay device outputs the field power calculated by the power calculating circuit after delaying it for one field. The subtractor calculates a difference between the field power of a present field calculated by the power calculating circuit and the field power of a previous field output from the 1-V delay device. The memory stores calculated power consumption in the data electrode drive circuit corresponding to a subfield, which is output from the subtractor. The adder adds calculated power consumption corresponding to a subfield read out from the memory and the field power calculated by the power calculating circuit, and outputs the power obtained by addition. The power predicting circuit may output the power output from the adder as predicted field power when the number of predetermined subfields is increased or decreased between the previous and the present fields.

REFERENCE MARKS IN THE DRAWINGS

Figure 1:
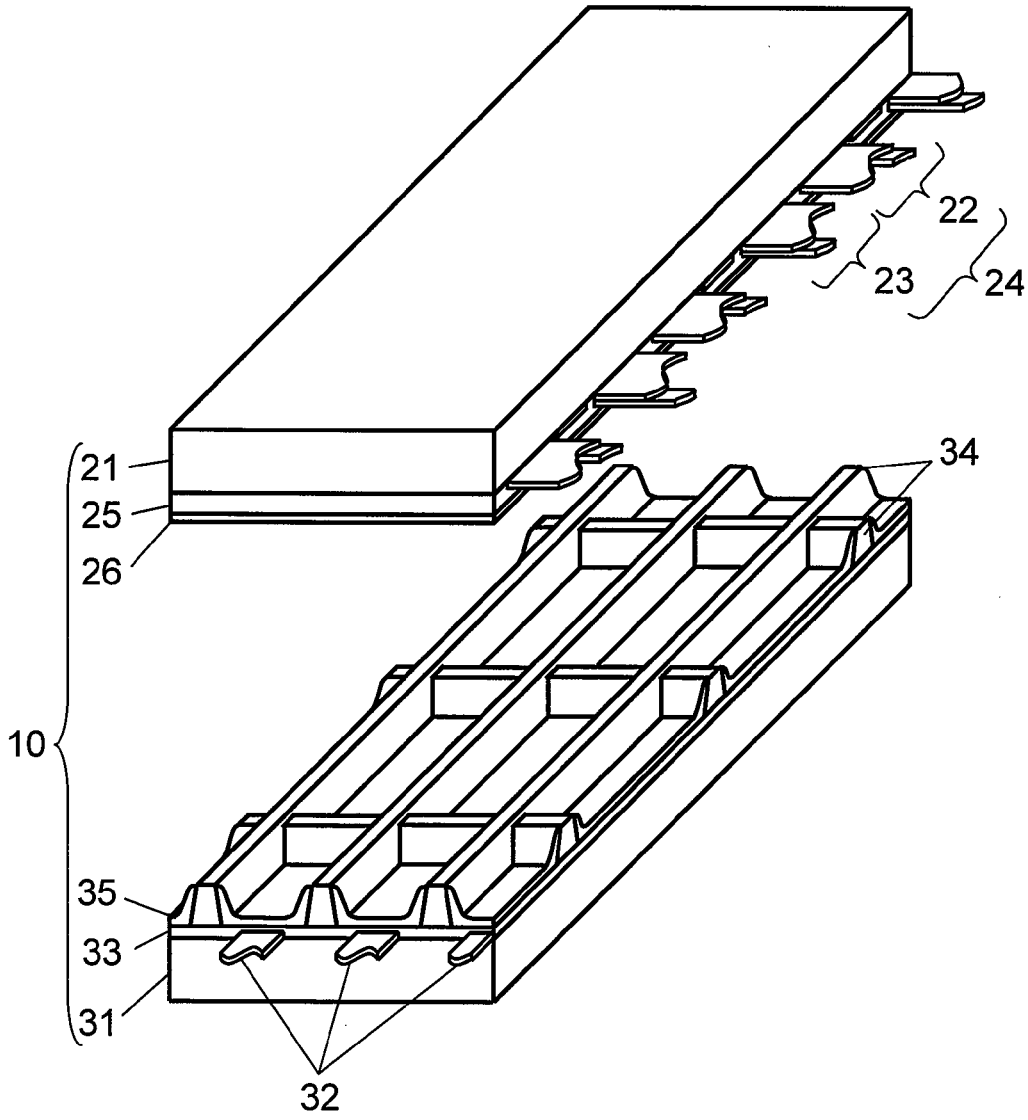
FIG. 1 is an exploded perspective view illustrating a panel structure in accordance with an exemplary embodiment of the present invention.

10 Panel
22 Scan electrode
23 Sustain electrode
24 Display electrode pair
32 Data electrode
41 Image signal processing circuit
42 Data electrode drive circuit
43 Scan electrode drive circuit
44 Sustain electrode drive circuit
45 Timing generating circuit
51 Scene change detecting circuit
52 SF conversion circuit
53 Image data replacement circuit
54 Power calculating circuit
56 Power predicting circuit
58 SF determination circuit
61 1-V delay device
62 Subtractor
63 Memory
64 Adder
71, 73 Comparator
74 NOT gate
76 Up-down counter
100 Plasma display device

DETAILED DESCRIPTION OF PREFERRED EMBODIMENTS

An exemplary embodiment of the present invention is described below with reference to drawings.

Exemplary Embodiment

FIG. 1 is an exploded perspective view illustrating a structure of panel 10 employed in the exemplary embodiment of the present invention. A plurality of display electrode pairs 24, each including scan electrode 22 and sustain electrode 23, are formed on front substrate 21 made of glass. Dielectric layer 25 covers scan electrodes 22 and sustain electrodes 23, and protective layer 26 is formed on this dielectric layer 25. A plurality of data electrodes 32 are formed on rear substrate 31, and dielectric layer 33 covers data electrodes 32. Barrier ribs 34 are formed in a grid on dielectric layer 33. Phosphor layer 35 that emits light in each color of red, green, and blue is provided on a side face of barrier ribs 34 and dielectric layer 33.

These front substrate 21 and rear substrate 31 are disposed such that display electrode pairs 24 and data electrodes 32 face each other with a small discharge space in between. Peripheries of front substrate 21 and rear substrate 31 are sealed with a sealant such as grass frit. A gas mixture of typically neon and xenon is filled as discharge gas in the discharge space. Barrier ribs 34 for partitioning the discharge space into a plurality of sections are formed, and a discharge cell is formed at each cross-section of display electrode pair 24 and data electrode 32. An image is displayed by discharging and emitting light from these discharge cells.

The structure of panel 10 is not limited to the above structure. For example, striped barrier ribs may be provided.

Figure 2:
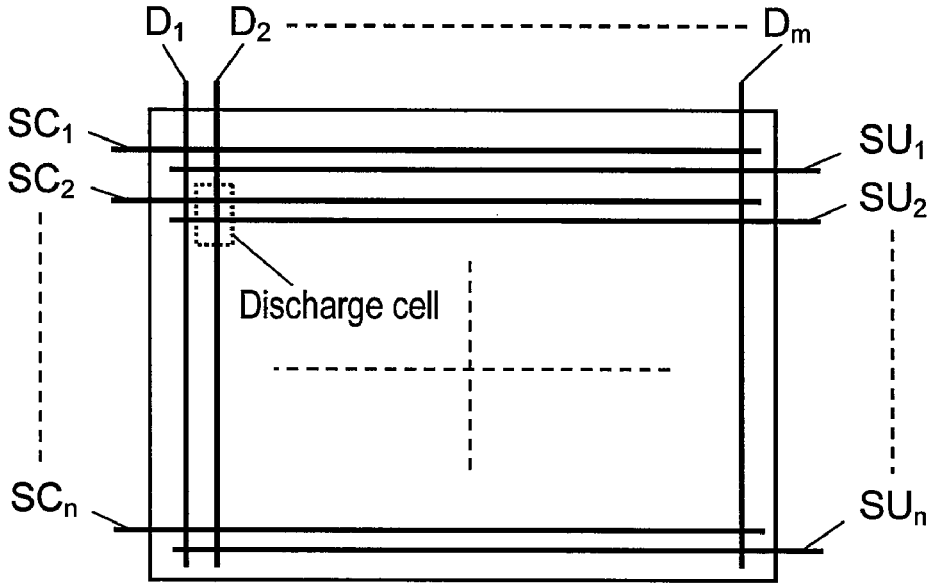
FIG. 2 is a panel electrode layout in accordance with the exemplary embodiment of the present invention.

FIG. 2 is an electrode layout of panel 10 employed in the exemplary embodiment of the present invention. Panel 10 includes the n number of scan electrodes SC1 to SCn (scan electrodes 22 in FIG. 1) and the n number of sustain electrodes SU1 to SUn (sustain electrodes 23 in FIG. 1) row-wise (in a line direction), and the m number of data electrodes D1 to Dm (data electrode 32 in FIG. 1) column-wise. The discharge cell is formed at a section where a pair of scan electrode SCi (i=1 to n) and sustain electrode SUi and one data electrode Dj (j=1 to m) cross. In the discharge space, the m×n number of discharge cells are formed.

Interelectrode capacitance exists between electrodes aligned as described above. In particular, with respect to interelectrode capacitance related to data electrodes D1 to Dm, the interelectrode capacitance exists at each cross-section of the display electrode pair and the data electrode, and between adjacent data electrodes.

Next, how the panel is driven is described. In this exemplary embodiment, a subfield method is adopted as a method of grayscale display corresponding to an image signal. In the subfield method, one field period is divided into a plurality of subfields. Grayscale display is achieved by controlling emission and non-emission of light from each discharge cell for each subfield.

In this exemplary embodiment, one field is, for example, divided into 10 subfields, and then each subfield is given luminance weight of "1", "2" "3", "6", "11" "18" "30", "44", "60" and "81" respectively.

Figure 3:
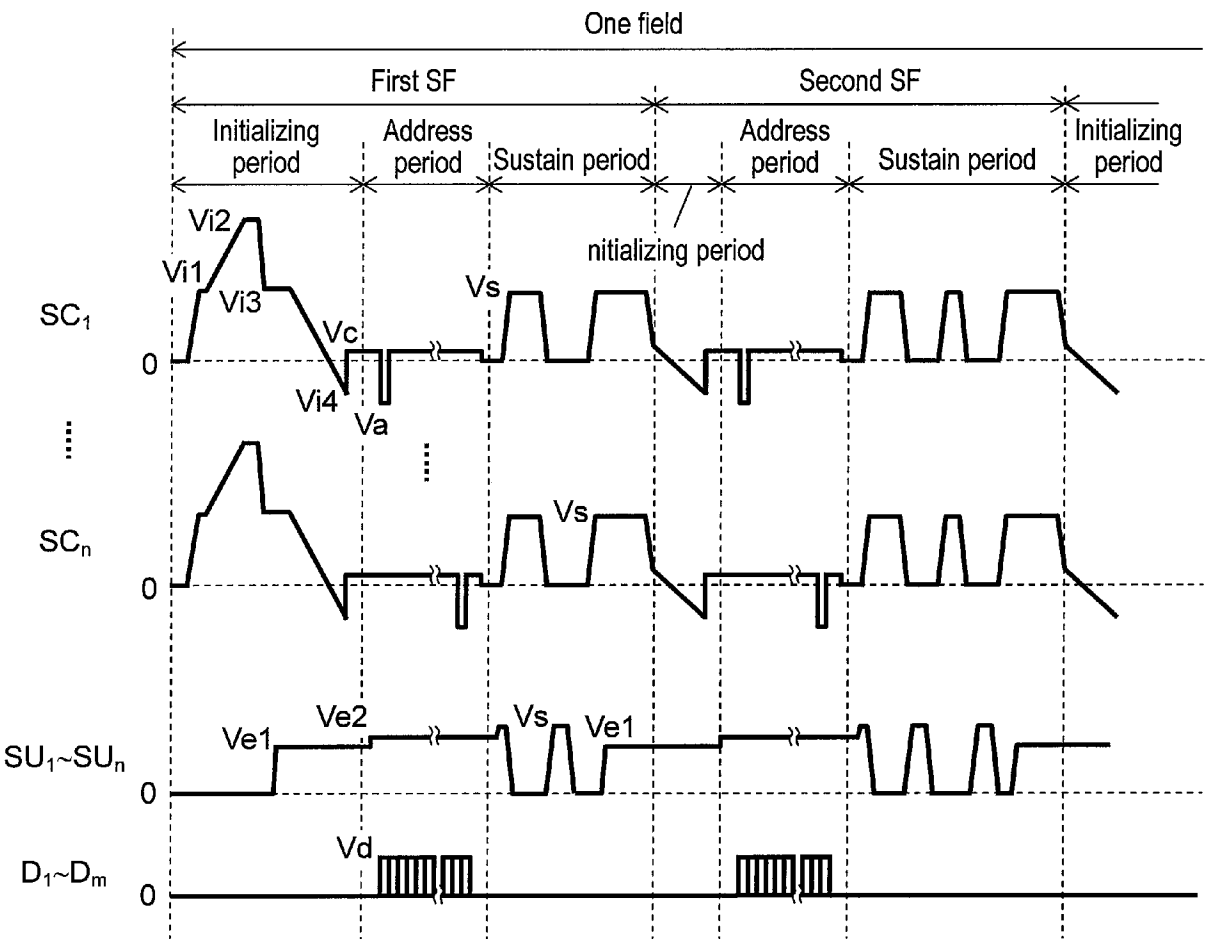
FIG. 3 illustrates a drive voltage waveform applied to each electrode in the panel of the plasma display device in accordance with the exemplary embodiment of the present invention.

Each subfield includes an initializing period, an address period, and a sustain period. FIG. 3 illustrates a drive voltage waveform applied to each electrode of panel 10 of the plasma display device in the exemplary embodiment of the present invention. In FIG. 3, the drive voltage waveform for two subfields, i.e., first SF and second SF, are shown.

In the initializing period of the first SF subfield, 0 V is applied to data electrodes D1 to Dm and sustain electrodes SU1 and SUn. In addition, a ramp voltage that moderately increases from voltage Vi1 to voltage Vi2 is applied to scan electrodes SC1 to SCn. Then, voltage Ve1 is applied to sustain electrodes SU1 to SUn, and a ramp voltage that moderately decreases from voltage Vi3 to voltage Vi4 is applied to electrodes SC1 to SCn. Then, a small initializing discharge occurs in each discharge cell, and a wall charge required for a subsequent address operation is formed on each electrode. As an operation in the initializing period, only a ramp voltage that moderately decreases may be applied to scan electrodes SC1 to SCn, as shown in the initializing period of second SF in FIG. 3.

In the subsequent address period, voltage Vet is applied to sustain electrodes SU1 to SUn, voltage Vc is applied to scan electrodes SC1 to SCn, and 0V is applied to data electrodes D1 to Dm, respectively. Next, scan pulse voltage Va is applied to scan electrode SC1 on the first line. In addition, address pulse voltage Vd is applied to data electrode Dk (k=1 to m) corresponding to a discharge cell to emit light. Then, address discharge occurs in a discharge cell on the first line to which scan pulse voltage Va and address pulse voltage Vc are simultaneously applied, and the address operation for accumulating a wall charge to scan electrode SC1 and sustain electrode SU1 takes place.

The same address operation is executed in discharge cells from the second line to the nth line so as to form the wall charge by selectively causing address discharge in discharge cells to emit light.

As described above, each data electrode Dj is a capacitive load. Therefore, this capacitive load needs to be charged and discharged every time voltage applied to each data electrode is switched from ground potential 0 V to address pulse voltage Vd, or from address pulse voltage Vd to ground potential 0 V. As the number of charges and discharges increases, power consumption in the data electrode drive circuit also increases, as described later.

In the subsequent sustain period, 0 V is applied to sustain electrodes SU1 to SUn. Sustain pulse voltage Vs is applied to scan electrodes SC1 to SCn. The sustain discharge occurs in discharge cells where address discharge has occurred, and the light is emitted.

Next, 0 V is applied to scan electrodes SC1 to SCn, and sustain pulse voltage Vs is applied to sustain electrodes SU1 to SUn. This causes sustain discharge again in discharge cells where sustain discharge has occurred, and the light is emitted. After this, the light is emitted from discharge cells by applying the sustain pulse, corresponding to luminance weight, alternately to scan electrodes SC1 to SCn and sustain electrodes SU1 to SUn. Then, sustain pulse voltage Vs is applied to scan electrodes SC1 to SCn, and voltage Ve1 is applied to sustain electrodes SU1 to SUn so as to execute so-called blanking of wall charge, and the sustain period is completed.

Also in a subsequent subfield, the light is emitted from discharge cells by repeating the same operation as that in the above subfields so as to display an image.

Figure 4:
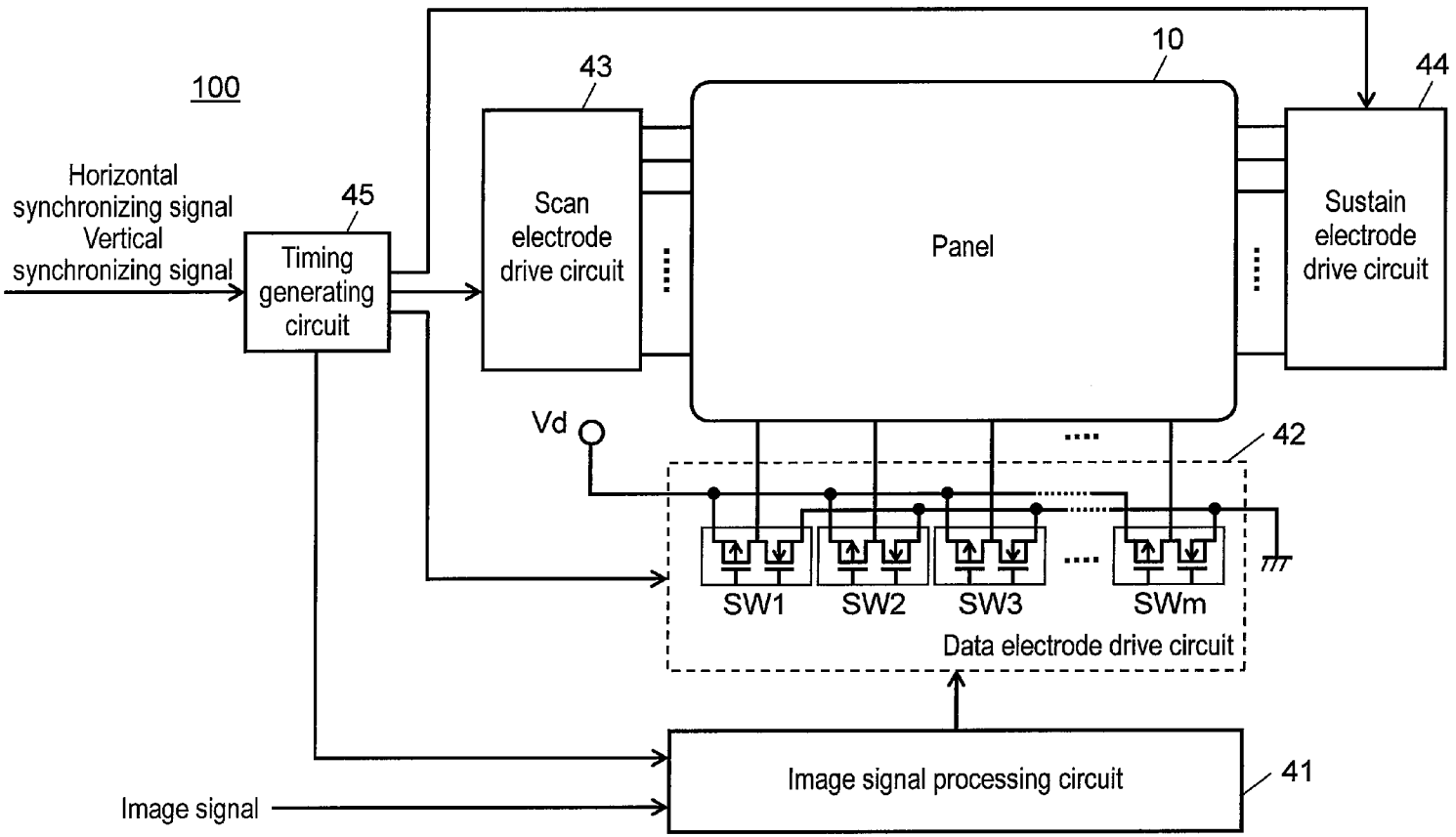
FIG. 4 is a circuit block diagram of the plasma display device in accordance with the exemplary embodiment of the present invention.

FIG. 4 is a circuit block diagram of plasma display device 100 in the exemplary embodiment of the present invention. Plasma display device 100 includes panel 10, image signal processing circuit 41, data electrode drive circuit 42, scan electrode drive circuit 43, sustain electrode drive circuit 44, timing generating circuit 45, and a power circuit (not illustrated) for supplying required power to each circuit block.

Image signal processing circuit 41 converts an image signal to image data that indicates emission and non-emission of light from each subfield, and also replaces image data so as to prevent power consumption in data electrode drive circuit 42 from becoming too large.

Data electrode drive circuit 42 has the m number of switch circuits SW1 to SWm. The m number of switches SW1 to SWm applies address pulse voltage Vd or 0 V to each of the m number of data electrodes D1 to Dm. Data electrode drive circuit 42 converts image data output from image signal processing circuit 41 to an address pulse corresponding to each of data electrodes D1 to Dm, and applies it to each of data electrodes D1 to Dm.

Timing generating circuit 45 generates a range of timing signals for controlling the operation of each circuit based on horizontal synchronizing signal and vertical synchronizing signal, and supplies these timing signals to each circuit, respectively. Scan electrode drive circuit 43 drives each of scan electrodes SC1 to SCn based on the timing signal. Sustain electrode drive circuit 44 drives sustain electrodes SU1 to SUn based on the timing signal.

Figure 5:
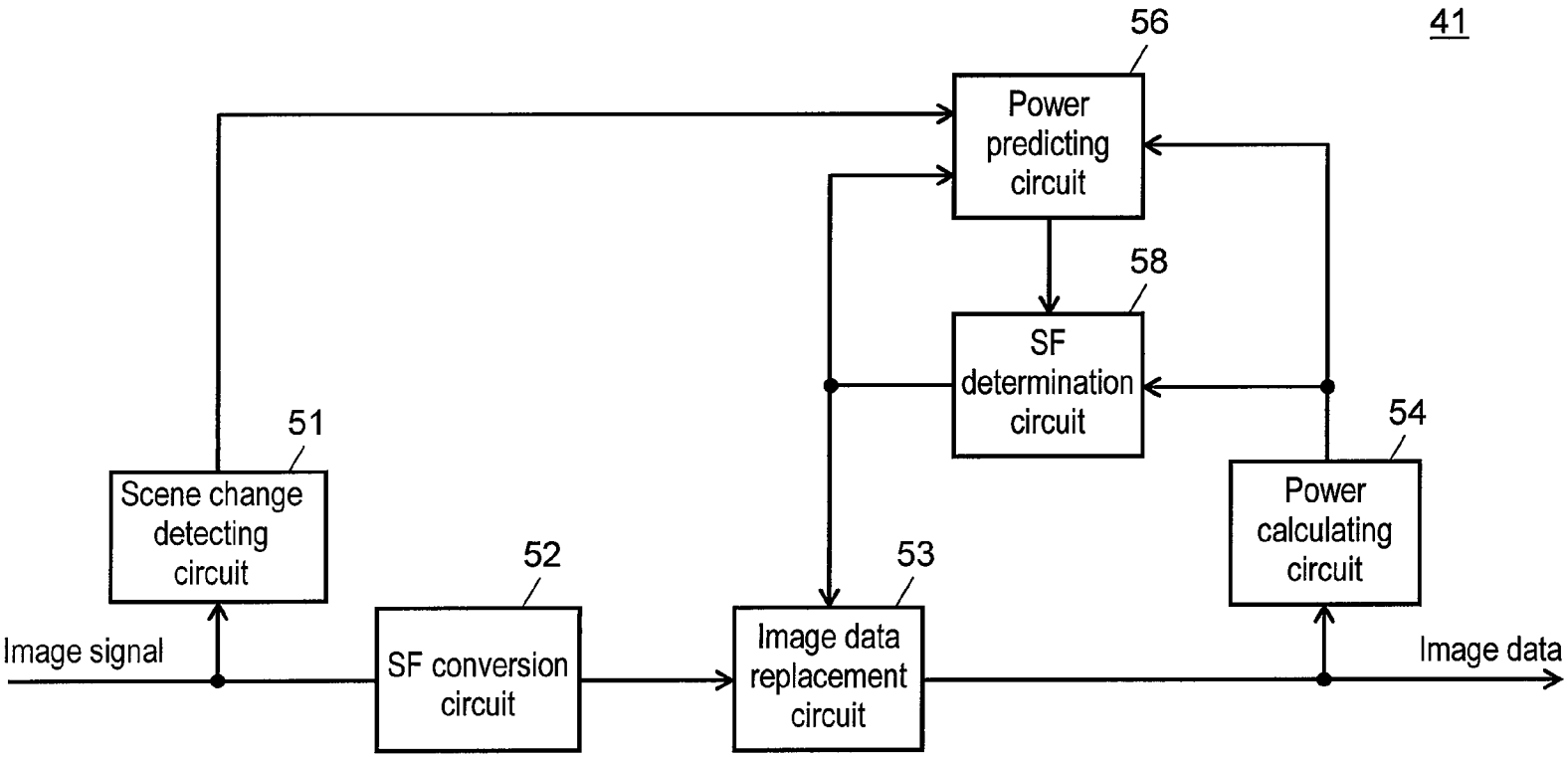
FIG. 5 is a detailed circuit block diagram of an image signal processing circuit in the plasma display device in accordance with the exemplary embodiment of the present invention.

FIG. 5 is a detailed circuit block diagram of image signal processing circuit 41 of plasma display device 100 in the exemplary embodiment of the present invention. Image signal processing circuit 41 includes scene change detecting circuit 51, SF conversion circuit 52, image data replacement circuit 53, power calculating circuit 54, power predicting circuit 56, and SF determination circuit 58.

Scene change detecting circuit 51 detects APL (Average Picture Level) of image signal for each field, and determines that a scene has changed if this APL changes exceeding a predetermined value. To detect APL, a level of image signal is successively measured by minimal time, and these measured levels are averaged over one field. In this exemplary embodiment, a predetermined change value in APL is, for example, 20%. However, the predetermined change value in APL is not limited to this value. The value differs by design conditions of panel 10, and thus set as required.

SF conversion circuit 52 converts the image signal to image data that indicates emission and non-emission of light from each subfield. Bits of image data correspond to subfields, and "1" or "0" of each bit indicates emission or non-emission of light from a corresponding subfield.

Image data replacement circuit 53 replaces image data of a predetermined subfield with image data that reduces power consumption in data electrode drive circuit 42. In this exemplary embodiment, image data replacement circuit 53 changes all bits of image data for the predetermined subfield, which is determined based on the output of SF determination circuit 58, to "0". As a result, the address operation of that subfield will be stopped. In this way, image data replacement circuit 53 replaces the image data with image data having less power consumption in data electrode drive circuit 42. Therefore, a significant power suppression effect is achievable in this exemplary embodiment. The predetermined subfield is detailed later.

Power calculating circuit 54 calculates power consumption in data electrode drive circuit 42 based on image data, and outputs power consumption in each field as field power. One method of calculating field power is to calculate the sum of exclusive OR of image data corresponding to adjacent discharge cells for each subfield, and then calculate the sum over one field. In this exemplary embodiment, power consumption in each exclusive IC configuring data electrode drive circuit 42 is calculated, and their maximum value is output as the field power.

Power predicting circuit 56 stores calculated power consumption in data electrode drive circuit 42 corresponding to each subfield, and also predicts the field power when the predetermined number of subfields is increased or decreased based on the calculated power consumption stored and the field power calculated by power calculating circuit 54. Then, power predicting circuit 56 outputs the field power obtained through prediction as predicted field power. If scene change detecting circuit 51 detects any change in a scene, calculated power consumption stored in power predicting circuit 56 is reset.

SF determination circuit 58 determines the number of subfields (predetermined subfields) whose data is replaced by image data replacement circuit 53, based on aforementioned field power and predicted field power. More specifically, as described below, SF determination circuit 58 increases the number of predetermined subfields if the field power is the same or greater than a predetermined power threshold. If the field power is less than the predetermined power threshold, and the predicted field power is also less than the predetermined power threshold, SF determination circuit 58 decreases the number of predetermined subfields. A specific value for predetermined power threshold is described later. This exemplary embodiment refers to, for example, "40" in the description.

Figure 6:
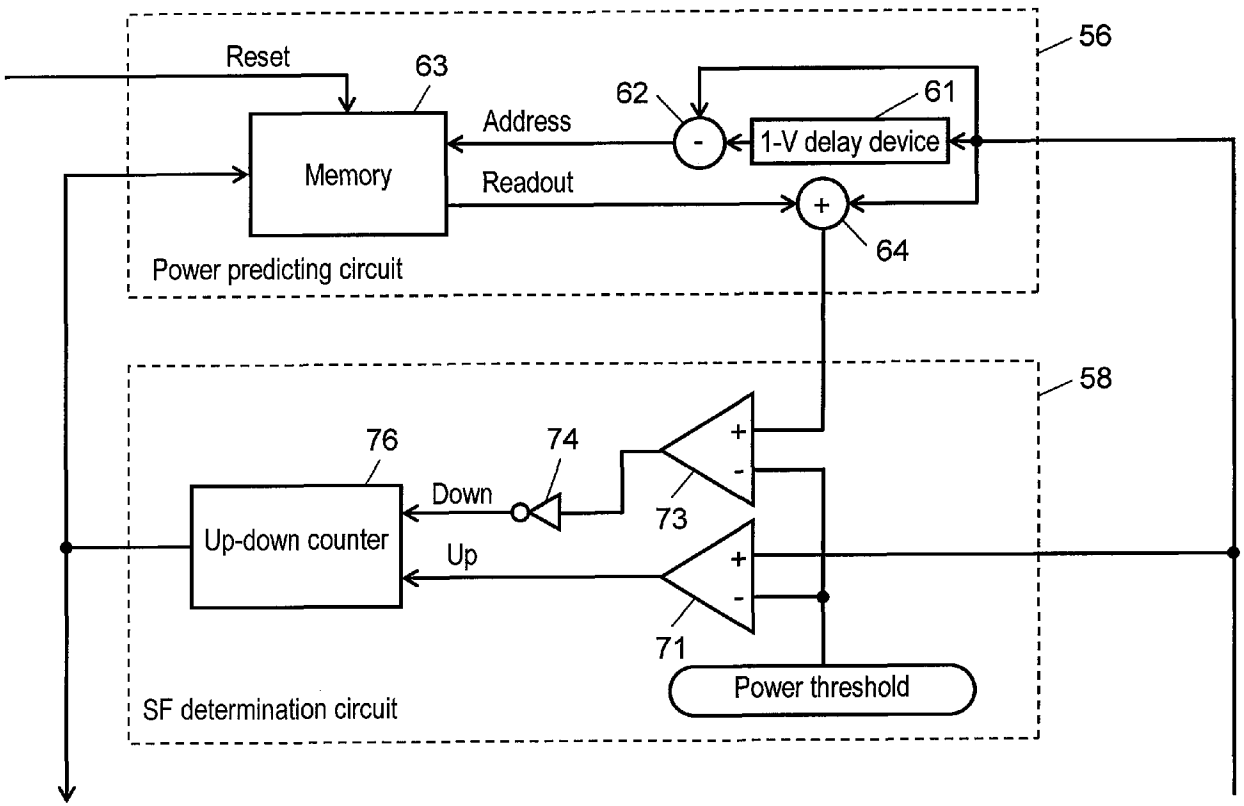
FIG. 6 is a detailed circuit block diagram of a power predicting circuit and an SF determination circuit in the plasma display device in accordance with the exemplary embodiment of the present invention.

FIG. 6 is a circuit block diagram illustrating details of power predicting circuit 56 and SF determination circuit 58 of plasma display device 100 in this exemplary embodiment of the present invention. Power predicting circuit 56 includes 1-V delay device 61, subtractor 62, memory 63, and adder 64.

1-V delay device 61 in power predicting circuit 56 outputs the field power calculated by power calculating circuit 54 after delaying it for one field. Subtractor 62 calculates a difference between the field power of a present field calculated by power calculating circuit 54 and the field power of a previous field output by 1-V delay device 61. Here, subtractor 62 can calculate power consumption in data electrode drive circuit 42 corresponding to a subfield added to the predetermined subfields if the number of predetermined subfields is increased between the previous field and the present field. Contrarily, if the number of predetermined subfields is decreased, subtractor 62 can calculate power consumption in data electrode drive circuit 42 corresponding to a subfield excluded from the predetermined subfields. This operation is detailed later.

Memory 63 stores a calculated value of power consumption in data electrode drive circuit 42 corresponding to a subfield output from subtractor 62. Adder 64 adds the calculated value of power consumption in data electrode drive circuit 42 corresponding to a subfield read out from memory 63 and the field power calculated by power calculating circuit 54. Then, adder 64 outputs this power obtained by addition as predicted field power. In other words, power predicting circuit 56 outputs the power output from adder 64 as predicted field power if the number of predetermined subfields is increased or decreased between the previous field and the present field. In this way, the calculated value of power consumption in data electrode drive circuit 42 corresponding to each subfield is stored in memory 63 of power predicting circuit 56. However, these calculated values are reset when scene change detecting circuit 51 detects any change in a scene.

SF determination circuit 58 includes comparator 71, comparator 73, NOT gate 74, and up-down counter 76. The output of up-down counter 76 is an integer number from "0" to "10" in this exemplary embodiment. This integer number indicates the number of predetermined subfields. In other words, if the output of up-down counter 76 is "0", it indicates that the predetermined subfield does not exist. The number of subfields indicates the number of subfields to replace data by image data replacement circuit 53. More specifically, image data replacement circuit 53 replaces image data for subfields in the order of larger luminance weight in first SF that has the smallest luminance weight to the number of subfields indicated by the number of predetermined subfields. For example, if the output of up-down counter 76 is "1", image data replacement circuit 53 changes all bits of image data corresponding to first SF to "0". If the output of up-down counter 76 is "5", image data replacement circuit 53 changes all bits of image data corresponding to first SF, second SF, third SF, fourth SF, and fifth SF to "0".

Up-down counter 76 executes up-counting when power consumption in data electrode drive circuit 42 becomes the same or greater than the predetermined power threshold, and increases the output only for "1". More specifically, comparator 71 compares the field power calculated by power calculating circuit 54 and the predetermined power threshold. If the field power is the same or greater than the predetermined power threshold, up-down counter 76 executes up-counting. Since bits of image data that are changed to "0" by image data replacement circuit 53 increases, power consumption in data electrode drive circuit 42 decreases.

If the power consumption in data electrode drive circuit 42 is less than the predetermined power threshold, the power consumption in data electrode drive circuit 42 when the output of up-down counter 76 is decreased for "1" is predicted. If this value is smaller than the predetermined power threshold, down-counting takes place, and the output is decreased only for "1". However, if a predicted value is the same or greater than the predetermined power threshold, the output is not changed. More specifically, a calculated value of power consumption in data electrode drive circuit 42 corresponding to a subfield indicated by up-down counter 76 is read out from memory 63. Then, adder 64 adds the calculated value of power consumption read out from memory 63 and field power calculated by power calculating circuit 54. This added value is predicted field power in data electrode drive circuit 42 when the output of up-down counter 76 is decreased only for "1" Comparator 73 compares this predicted field power and the predetermined power threshold, and executes down-counting in up-down counter 76 if the predicted field power is less than the predetermined power threshold. In other cases, the output of up-down counter 76 is not changed.

In this exemplary embodiment, as described earlier, one field is divided into, for example ten subfields, and luminance weight given to each subfield is increased in the order of subfields from first SF. Therefore, in this example, if an integer number output from up-down counter 76 is 5, bits of image data corresponding to first SF to fifth SF are all changed to "0". However, luminance weight given to each subfield may not be increased in the order of subfields from first SF.

Accordingly, image data replacement circuit 53 adds a subfield with the next largest luminance weight after a subfield with the largest luminance weight in the predetermined subfields to the predetermined subfields if the number of predetermined subfields is increased. If the number of predetermined subfields is decreased, corresponding to the output of SF determination circuit 58, image data replacement circuit 53 excludes the subfield with the largest luminance weight in the predetermined subfields from the predetermined subfields. If there is only one predetermined subfield, a subfield with the smallest luminance weight is designated as the predetermined subfield. In other words, image data replacement circuit 53 changes all bits of image data to "0" in the order of large luminance weight in the subfield that has the smallest luminance weight to the number of subfields indicated by the number of predetermined subfields. This minimizes a change in luminance of panel 10 in line with increase or decrease of power consumption.

Figure 7:
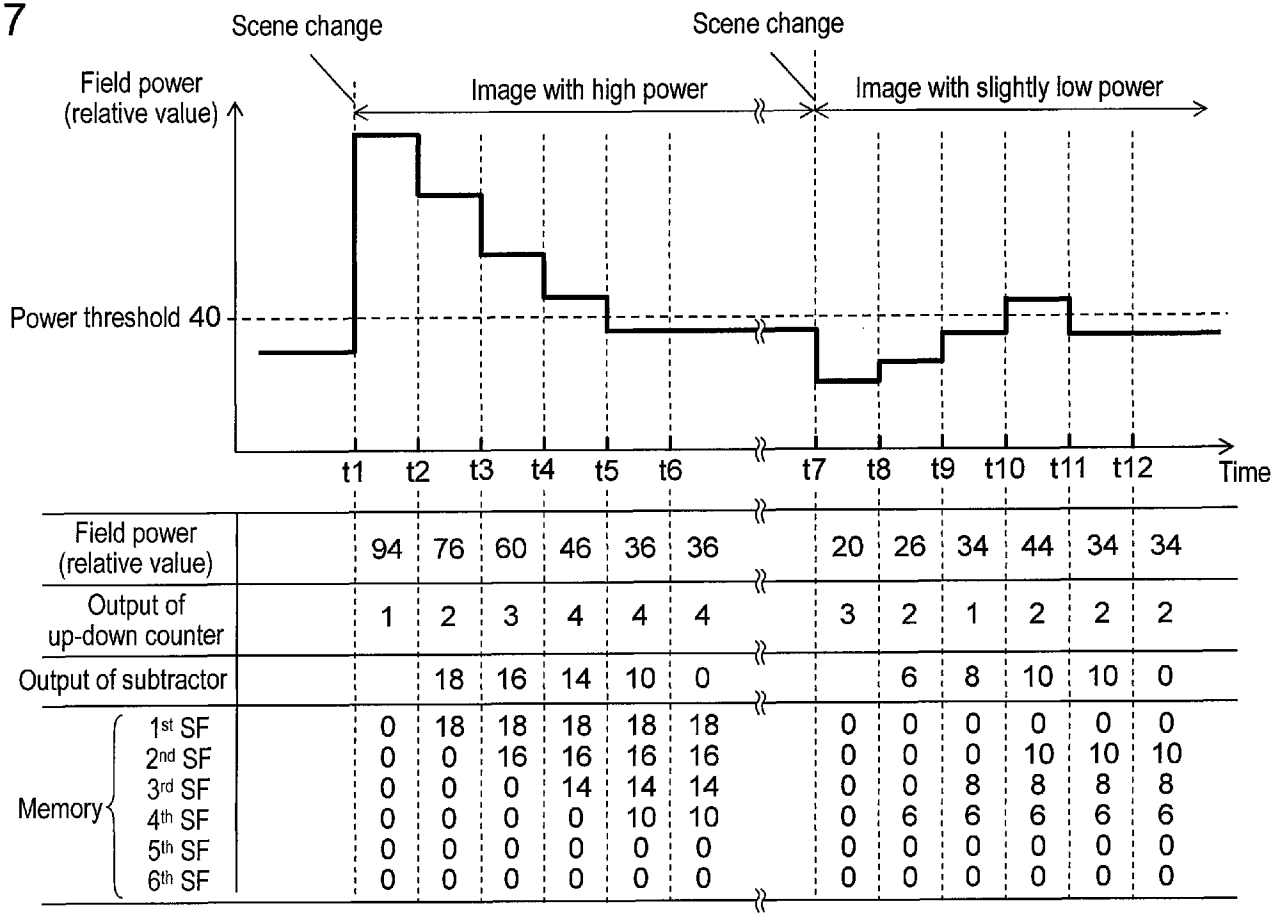
FIG. 7 illustrates the operation of the image signal processing circuit in the plasma display device in accordance with the exemplary embodiment of the present invention.

Next, the operation of image signal processing circuit 41 is described in details. FIG. 7 illustrates the operation of image signal processing circuit 41 of plasma display device 100 in the exemplary embodiment of the present invention, and shows an example of changes in power consumption calculated by power calculating circuit 54. FIG. 7 also shows the output of up-down counter 76, output of subtractor 62, and changes in calculated power consumption corresponding to each subfield (first SF to sixth SF) stored in memory 63. In FIG. 7, changes in calculated power consumption corresponding to seventh SF to tenth SF are the same as that of sixth SF, and thus they are omitted in the drawing. The field power calculated by power calculating circuit 54 is indicated in a relative value, and the predetermined power threshold is "40" in description below.

First, let's say a scene is changed at time t1, and an image signal with large power consumption in data electrode drive circuit 42 is input. A relative value for the field power calculated by power calculating circuit 54 at this point is "94". Since a scene has changed, a value of power consumption corresponding to each subfield stored in memory 63 is all reset to "0".

Comparator 71 compares field power "94" calculated by power calculating circuit 54 and predetermined power threshold "40". Since field power "94" is greater than predetermined power threshold "40", up-down counter 76 executes up-counting, and outputs "1".

At time t2 for the next field, image data replacement circuit 53 replaces a bit of image data for first SF to "0." Then, power consumption in data electrode drive circuit 42 decreases, and let's say the field power calculated by power calculating circuit 54 at this point becomes "76". Subtractor 62 calculates a difference between an output of 1-V delay device 61, i.e., field power "94" of the previous field, and field power "76" of the present field. Then, memory 63 stores this difference "18" as calculated power consumption in data electrode drive circuit 42 for first SF.

Comparator 71 also compares field power "76" and predetermined power threshold "40". Since field power "76" is still greater than predetermined power threshold "40", up-down counter 76 executes up-counting and outputs "2".

At time t3 for the next field, image data replacement circuit 53 changes bits of image data for first SF and second SF to "0". Then, power consumption in data electrode drive circuit 42 decreases, and the field power at this point becomes, let's say, "60". Memory 63 stores difference "16" between field power "76" of the previous field and field power "60" of the present field as calculated power consumption in data electrode drive circuit 42 for second SF.

Since field power "60" of the present field is still greater than predetermined power threshold "40", up-down counter 76 executes up-counting and outputs "3".

At time t4 for the next field, image data replacement circuit 53 changes bits for first SF to third SF to "0". Then, power consumption in data electrode drive circuit 42 further decreases, and the field power becomes "46". Memory 63 stores difference "14" between field power "60" of the previous field and field power "46" of the present field as calculated power consumption in data electrode drive circuit 42 for third SF.

Since field power "46" of the present field is still greater than predetermined power threshold "40", up-down counter 76 executes up-counting and outputs "4".

At time t5 for the next field, image data replacement circuit 53 changes bits of image data for first SF to fourth SF to "0". Then, power consumption in data electrode drive circuit 42 further decreases to field power "36". Memory 63 stores difference "10" between field power "46" of the previous field and field power "36" of the present field as calculated power consumption in data electrode drive circuit 42 for fourth SF.

Since field power "36" of the present field is now less than predetermined power threshold "40", up-down counter 76 does not execute up-counting. In addition, power consumption "10" in data electrode drive circuit 42 for a subfield that up-down counter 76 indicates, i.e., fourth SF, is read out from memory 63. Adder 64 adds calculated power consumption "10" read out from memory 63 and field power "36" of the present field. Then, adder 64 outputs value "46" obtained through addition as predicted field power "46". Comparator 73 compares predicted field power "46" and predetermined power threshold "40". Here, since predicted field power "46" is greater than predetermined power threshold "40", up-down counter 76 does not execute down-counting, and thus the output remains "4".

Next, at time t7, a scene changes, and an image signal with less power consumption in data electrode drive circuit 42 is input. Let's say a relative value of the field power calculated by power calculating circuit 54 is "20". Since a scene has changed, calculated power consumption for each subfield stored in memory 63 is all reset to "0."

Comparator 71 compares this field power "20" and predetermined power threshold "40". Since field power "20" is less than predetermined power threshold "40", up-down counter 76 does not execute up-counting. On the other hand, power consumption "0" in data electrode drive circuit 42 for a subfield indicated by up-down counter 76, i.e., fourth SF, is read out from memory 63. Then, adder 64 adds calculated power consumption "0" read out from memory 63 and field power "20" for the present field. Then, adder 64 outputs value "20" obtained through addition as predicted field power "20". Comparator 73 compares predicted field power "20" and predetermined power threshold "40". Since predicted field power "20" is less than predetermined power threshold "40", up-down counter 76 executes down-counting, and outputs "3".

At time t8 for the next field, image data replacement circuit 53 stops replacing bits of image data for fourth SF, and replaces a bit for first SF to third SF with "0". Then, the power consumption in data electrode drive circuit 42 increases, and let's say, the field power becomes "26". Then, memory 63 stores difference "6" between field power "20" of the previous field and field power "26" of the present field as calculated power consumption in data electrode drive circuit 42 for fourth SF.

Since field power "26" of the present field is less than predetermined power threshold "40", up-down counter 76 does not execute up-counting. On the other hand, since predicted field power "26" that is the total of value "0" of memory 63 for a subfield indicated by up-down counter 76, i.e., third SF, and field power "26" of the present field is less than predetermined power threshold "40", up-down counter 76 executes down-counting and outputs "2".

At time t9 for the next field, image data replacement circuit 53 stops changing a bit of image data for third SF, and changes bits for first SF and second SF to "0". Then, power consumption in data electrode drive circuit 42 further increases, and the field power becomes "34". Memory 63 then stores difference "8" between field power "26" of the previous field and field power "34" of the present field as calculated power consumption in data electrode drive circuit 42 for third SF.

Since field power "34" of the present field is less than predetermined power threshold "40", up-down counter 76 does not execute up-counting. On the other hand, since predicted field power "34" that is the total of calculated power consumption "0" read out from memory 63 for second SF and field power "34" of the present field is less than predetermined power threshold "40", up-down counter 76 executes down-counting and outputs "1".

At time t10 for the next field, image data replacement circuit 53 stops replacing a bit of image data for second SF, and changes a bit for first SF to "0". Then, power consumption in data electrode drive circuit 42 further increases and, let's say, the field power becomes "44". Memory 63 stores difference "10" between field power "34" of the previous field and field power "44" of the present field as calculated power consumption in data electrode drive circuit 42 for second SF.

Since field power "44" of the present field is greater than predetermined power threshold "40", up-down counter 76 executes up-counting, and outputs "2".

At time t11 for the next field, image data replacement circuit 53 changes bits of image data for first SF and second SF to "0". Then, power consumption in data electrode drive circuit 42 decreases, and the field power becomes "34". Memory 63 stores difference "10" between field power "44" of the previous field and field power "34" of the present field as calculated power consumption in data electrode drive circuit 42 for second SF.

Since field power "34" of the present field is less than predetermined power threshold "40", up-down counter 76 does not execute up-counting. In addition, calculated power consumption "10" in data electrode drive circuit 42 for a subfield indicated by up-down counter 76, i.e., second SF, is read out from memory 63. Then, adder 64 adds calculated power consumption "10" read out from memory 63 and field power "34" of the present field. Comparator 73 compares predicted field power "44" obtained through addition and predetermined power threshold "40". Here, since predicted field power "44" is greater than predetermined power threshold "40", up-down counter 76 does not execute down-counting, and the output remains "2".

As described above, plasma display device 100 in this exemplary embodiment calculates power consumption in data electrode drive circuit 42 corresponding to an image signal for the present field, and outputs power consumption in each field as field power. Plasma display device 100 then compares this calculated field power and predetermined power threshold, and also predicts the field power of data electrode drive circuit 42 when image data is replaced with that of less power consumption in data electrode drive circuit 42, so as to compare this predicted field power and predetermined power threshold. Based on this comparison result, plasma display device 100 controls the field power in data electrode drive circuit 42 such that it becomes not greater than the predetermined power threshold. Accordingly, a risk of flickering is eliminated although the feedback control is adopted, ensuring suppression of the power consumption in data electrode drive circuit 42.

In this exemplary embodiment, image data replacement circuit 53 decreases power consumption by changing image data to "0" in the order of subfields that has smaller luminance weight. However, the present invention is not limited to this sequence. For example, a method described in Patent Document 2 is also applicable. More specifically, grayscale values of image data corresponding to two vertically adjacent discharge cells are compared. If a grayscale value of image data corresponding to an upper discharge cell (upper data) is smaller than a grayscale value of image data corresponding to a lower discharge cell (lower data), the upper data is output without any change. On the other hand, if the grayscale value of upper data is greater than the grayscale value of lower data, the upper data is converted and output such that a light-emission state becomes the same between the upper discharge cell and lower discharge cell in the order of subfields with smaller luminance weight.

The number of subfields and luminance weight in each subfield are not limited to values described above in the present invention. Specific numeric values in the exemplary embodiment are given just as examples. Accordingly, appropriate values are preferably set in accordance with panel characteristics and specifications of each plasma display device.

INDUSTRIAL APPLICABILITY

The present invention adopts the feedback control using a single predetermined power threshold, and reduces power consumption in a data electrode drive circuit without causing flickering. Accordingly, the present invention is efficiently applicable to plasma display devices.

The invention claimed is:

1. A plasma display device comprising:

a plasma display panel in which a plurality of discharge cells having data electrodes are aligned;

a data electrode drive circuit for driving the data electrodes; and an image signal processing circuit for processing an image signal and supplying image data for each subfield to the data electrode drive circuit; the image signal processing circuit including:

an image data replacement circuit for replacing image data for a predetermined subfield with image data having less power consumption in the data electrode drive circuit;

a power calculating circuit for calculating power consumption in the data electrode drive circuit and outputting power consumption in each field as field power;

a power predicting circuit for storing calculated power consumption in the data electrode drive circuit corresponding to a subfield, predicting field power when the number of the predetermined subfields is increased or decreased based on the stored calculated power consumption and the field power, and outputting the field power obtained through prediction as predicted field power; and an SF determination circuit for determining the number of predetermined subfields based on the field power and the predicted field power;

wherein the SF determination circuit:

increases the number of predetermined subfields when the field power is not less than a predetermined power threshold; and decreases the number of predetermined subfields when the field power is less than the predetermined power threshold and also the predicted field power is less than the predetermined power threshold.

2. The plasma display device of claim 1, wherein the image data replacement circuit replaces the image data for the predetermined subfield with image data having less power consumption in the data electrode drive circuit by replacing the image data with "0".

3. The plasma display device of claim 1, wherein the image signal processing circuit further includes a scene change detecting circuit for detecting Average Picture Level of image signal for each field, and determining that there is a scene change if a change in the Average Picture Level exceeds a predetermined value, wherein the power predicting circuit resets the calculated power consumption stored in the power predicting circuit if the scene change detecting circuit detects the scene change.

4. The plasma display device of claim 1, wherein the image data replacement circuit changes the number of predetermined subfields corresponding to an output of the SF determination circuit such that:

to increase the number of subfields, a subfield having next largest luminance weight after a subfield having the largest luminance weight in the predetermined subfield is added to the predetermined subfield; and to decrease the number of subfields, the subfield having the largest luminance weight in the predetermined subfield is excluded from the predetermined subfield.

5. The plasma display device of claim 1, wherein the power predicting circuit includes:

a 1-V delay device for outputting the field power calculated by the power calculating circuit after delaying it for one field;

a subtractor for calculating a difference between field power of a present field calculated by the power calculating circuit and field power of a previous field output from the 1-V delay device;

a memory for storing calculated power consumption in the data electrode drive circuit corresponding to a subfield output from the subtractor; and an adder for adding the calculated power consumption corresponding to the subfield read out from the memory and the field power calculated by the power calculating circuit, and outputting the power obtained through addition, wherein the power predicting circuit outputs the power output from the adder as the predicted field power when the number of predetermined subfields is increased or decreased between the previous field and the present field.

* * * * *